US011813765B1

(12) United States Patent
Stark

(10) Patent No.: US 11,813,765 B1
(45) Date of Patent: Nov. 14, 2023

(54) CUTTING SYSTEM WITH REGISTRATION TRANSFER SYSTEM

(71) Applicant: Infinite-Motion Control, Inc., Cedarburg, WI (US)

(72) Inventor: Richard C. Stark, Saukville, WI (US)

(73) Assignee: Infinite-Motion Control, Inc., Cedarburg, WI (US)

( * ) Notice: Subject to any disclaimer, the term of this patent is extended or adjusted under 35 U.S.C. 154(b) by 479 days.

(21) Appl. No.: 17/164,337

(22) Filed: Feb. 1, 2021

Related U.S. Application Data

(60) Provisional application No. 62/969,403, filed on Feb. 3, 2020.

(51) Int. Cl.
*B26D 5/00* (2006.01)

(52) U.S. Cl.
CPC ..... *B26D 5/005* (2013.01); *B26D 5/007* (2013.01)

(58) Field of Classification Search
CPC ..... B26D 5/00; B26D 5/005; B26D 5/007
USPC ..... 83/76.1
See application file for complete search history.

(56) References Cited

U.S. PATENT DOCUMENTS

RE28,732 E * 3/1976 von Hofe ..... B65C 9/44 156/64
2009/0320660 A1* 12/2009 Gwosdz-Kaupmann ..... B65H 23/046 83/40
2018/0117786 A1* 5/2018 Schuster ..... B26D 5/02
2018/0215060 A1* 8/2018 Johnson ..... B41M 3/003

* cited by examiner

*Primary Examiner* — Nhat Chieu Q Do
(74) *Attorney, Agent, or Firm* — Boyle Fredrickson, S.C.

(57) ABSTRACT

A cutting system for cutting sheets of material can automatically transfer original registration marks or other indicia from one side of the material to an opposite side, in direct alignment with the original registration marks or other indicia. The cutting system includes a cutting station, a feed station, and a registration transfer system between the feed and cutting stations. The registration transfer system includes a camera or other detector that moves in unison with a pen or other marker-type device to respectively detect the original registration marks or other indicia and apply a registration marks or other indicia on the sheets.

8 Claims, 4 Drawing Sheets

CUTTING SYSTEM WITH REGISTRATION TRANSFER SYSTEM

CROSS-REFERENCE TO RELATED APPLICATION

This application claims the benefit of U.S. Provisional Patent App. No. 62/969,403 filed Feb. 3, 2020, the entirety of which is incorporated by reference herein for all purposes.

FIELD OF THE INVENTION

The invention relates generally to sheet material or board cutting systems.

BACKGROUND OF THE INVENTION

Automated cutting systems for cutting sheet-type media such as, e.g., individual sheets of material, are known. These can include digital cutting machines or digital die cutting machines that cut material(s) for use in packaging, including POP (point of purchase) packaging or other items, sign and display, and other applications requiring complex cutting of irregular shapes, creasing or routering. Such digital cutting applications typically require placing the printed material(s) onto a table of the digital cutting machine with the print-side up to allow an overhead camera to locate printed registration marks on the material. Although sheets of material can be loaded onto the digital cutting machine's table in approximately the same location, different sheets can have slight dimensional variations and the sheets otherwise do not load in the exact same location or with exactly the same orientation, which compromises cutting accuracy. Accordingly, based on the particular locations of the registration marks identified by the overhead camera, the digital cutter adjusts its previously loaded cut file to accommodate the particular location and orientation of a respective sheet.

Using digital cutting machines to produce boxes and packaging from corrugated materials is becoming very common as consumer products are shipped directly to the consumer's residence. This also corresponds to advances in high quality digital printing that allow application of such imagery on boards of corrugated material used to make corrugated boxes and packaging. This may also correspond to a recognition that such attractive boxes and packaging made from boards of corrugated materials with high quality imagery can help create product appeal to consumers.

However, cutting and creasing of corrugated materials must be performed on digital cutting machines with the print-side down. In this print-side down orientation, there are no top-side registration marks that can be detected for locating the image so the cut file can be adjusted to facilitate accurate cut paths, which presents numerous substantial challenges to locating the print-side down image(s) on the board.

SUMMARY OF THE INVENTION

In accordance with a first aspect of the invention, a registration mark transfer system, which may be implemented as an underside registration transfer system, is incorporated into a cutting system to automatically and accurately transfer registration marks from a print-side-down surface to a top surface of a sheet or board of material.

According to another aspect of the invention, the underside registration transfer system may be an electromechanical system that can reside or be arranged between a board feeder and a digital cutting machine. The board feeder picks up individual boards (for example corrugated boards) and transfers these boards horizontally forward to the digital cutting machine.

According to another aspect of the invention, the underside registration transfer system may be positioned in-between the board feeder and a cutting table. The feeder moves the board horizontally over the underside registration transfer system between the board feeder and the cutting table in such a way that the underside registration transfer system can detect the registration marks on the print-side-down image and then transfer these marks to the exact corresponding locations on the opposite or top side of the board.

According to another aspect of the invention, the underside registration transfer system uses a vision camera(s) and servo driven mechanisms to determine the positions of the registration marks on the print-side-down image. Using a pen or other marking device, the underside registration transfer system will transfer the registration marks to the opposite or top side (upwardly facing as it advances through the cutting system) of the board. With the registration marks transferred to the top side of the board, the cutting system can use a traditional registration camera to align the print to cut for the image printed top-side-down on the cutting table.

These and other features and aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the scope of the invention.

Figure 1:
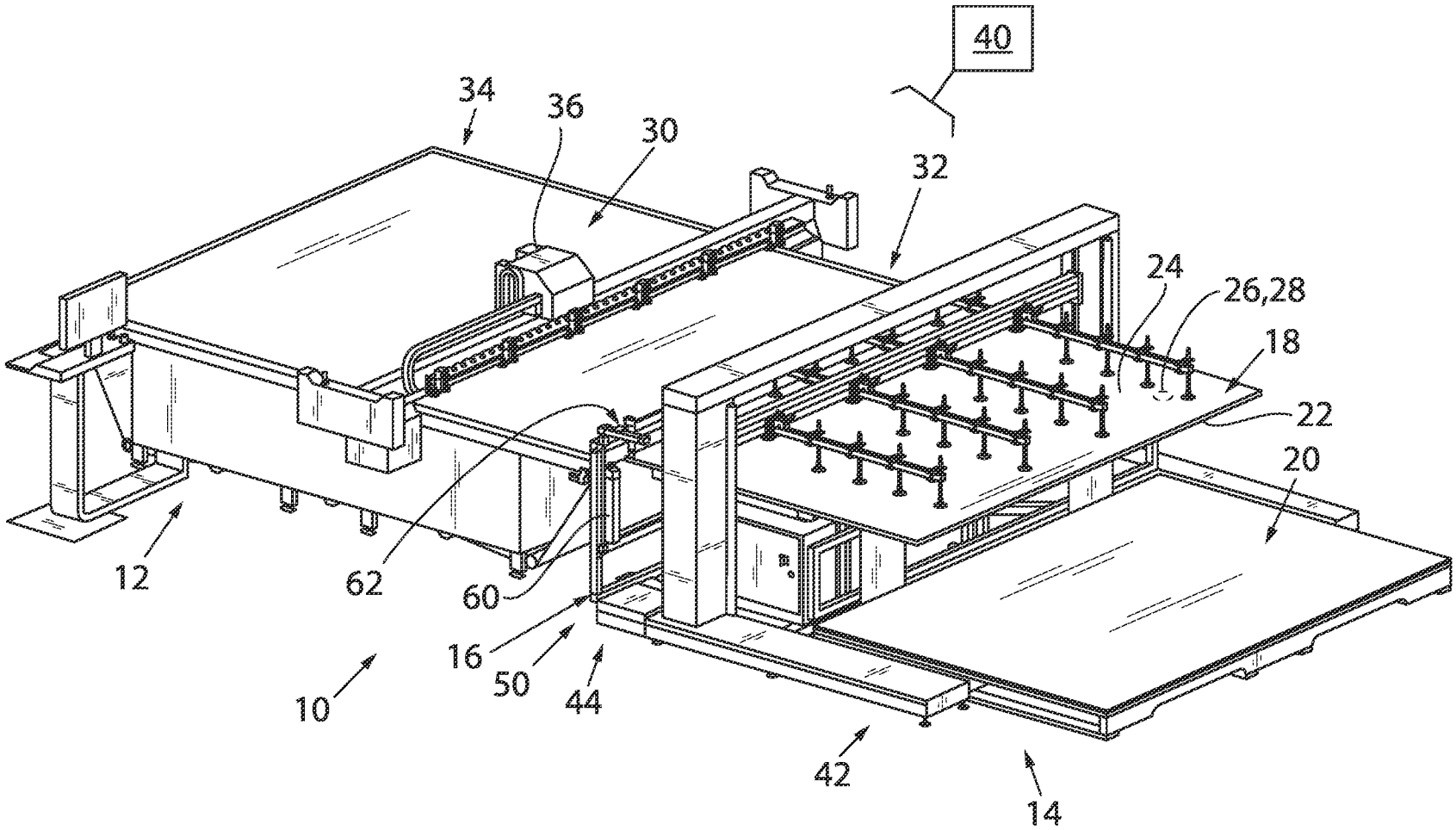
FIG. 1 is a pictorial view of a cutting system according to the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to the drawings and initially to FIG. 1, a cutting system 10 is shown with a cutting table or station 12, a feed station 14, and an indicia transfer system. The indicia transfer system is shown as registration transfer system 16 that allow the cutting system to cut pieces from sheets of material with downwardly facing images or other indicia, shown as corrugated boards 18 that are stored in a stack 20 at feed station 14. Each board 18 has first and second sides such as bottom and top sides 22, 24 and has downwardly facing indicia 26, such as images and registration marks 28 at the bottom side 22. Registration transfer system 16 is configured to transfer the registration marks 28 or other indicia 26 from the bottom side 22 to the top side 24 of board 18 for use by the cutting station 12 in cutting board(s) 18. Boards 18 may be made from a corrugated paper-type or other material for making boxes, packaging, retail displays, or the like.

Still referring to FIG. 1, cutting station 12 includes cutting table 30 that defines a cutting station inlet end 32 as an upstream end that receives the board 18 into cutting station 12 as an uncut board 18. Cutting station out end 34 is at a downstream end that delivers the board 18 out of cutting station 12 as a cut board 18. Cutting table 30 typically includes a conveyor belt drive system which may cover the entire upper surface of cutting table 30 and provide a moving surface to carry the board 18 onto and across the cutting table 30. A cutter/camera head 36 is electronically movable above cutting table 30 to cut the board 18 according to a cut file that is preloaded into a control system 40 that controls movement of the cutter/camera head 36. Suitable cutting stations are available as digital cutting machines or digital die cutting machines available from Esko-Graphics BV and other digital finishing equipment providers.

Still referring to FIG. 1, although control system 40 is schematically represented as a single overall system, it is understood that control system 40 is typically implemented as several different controllers or control systems that respectively control the various operation of cutting system 10 and its subsystems and components. For example, each of the cutter or cutting station 12, board feeder or board feed station 14, and registration transfer system 16, may have its own separate controller or control systems. These collectively control the respectively electromechanical and pneumatic components of the cutting station 12, feed station 14, and registration transfer system 16 to control individually feeding boards 18 from their storage stack 20 toward cutting station 12, detecting registration marks on the bottom side and transferring them to the top side of boards 18, continuing to feed the boards 18 to cutting station 12, cutting the boards 18 and then removing the cut boards 18 from the cutting station 12. Regardless, each control system includes a computer which may be an industrial computer or, for example, a PLC (programmable logic controller), along with corresponding software and suitable memory for storing such software and hardware including interconnecting conductors for power and signal transmission between components of the cutting system 10. The computer(s) of control system(s) 40 executes various stored programs which include cut files that provide cut paths for cutting at cutting station 12 while receiving inputs from and sending commands to various actuators and other components of cutting system 10 for the moving of boards 18, transferring registration marks or other indicia, and cutting the boards 18. In implementations with multiple control systems 40, such control systems may communicate with each other through, for example, industry recognized protocols and communication buses.

Still referring to FIG. 1, feed station 14 includes inlet end 42 that stores the stack 20 of boards 18 and outlet end 44 from which each board 18 is delivered toward cutting station 12. Feed station 14 is shown here with a feeder frame 46 that is a gantry-style framework of mechanical devices that supports a lift mechanism 48 such as a servo controlled lift mechanism. Lift mechanism 48 actuates vertically to engage a board 18 from stack 20 and feeder frame 46 actuates horizontally or toward and away from cutting station 12 to advance the board 18 toward cutting station 12. Suitable feed stations are available as automatic board feeder machines available from Infinite Motion Control, Inc.

Still referring to FIG. 1, registration transfer system 16 is configured to detect registration marks 28 or other indicia 26 on the bottom side 22 of board 18 and transfer them to the top side 24 of board 18 for detection by the cutting station 12. Registration system 16 includes detector assembly 60 that moves with respect to the uncut sheet of material such as board 18 and detects the registration marks 28 or other indicia 26 on the bottom side 22 of board 18, before entering the cutting station 12. Marker assembly 62 moves in coordination with the detector assembly 60 and is arranged to apply a mark or otherwise recreate the registration marks 28 or other indicia 16 to the top side 24 of the uncut board 18, before entering the cutting station 12.

Figure 2:
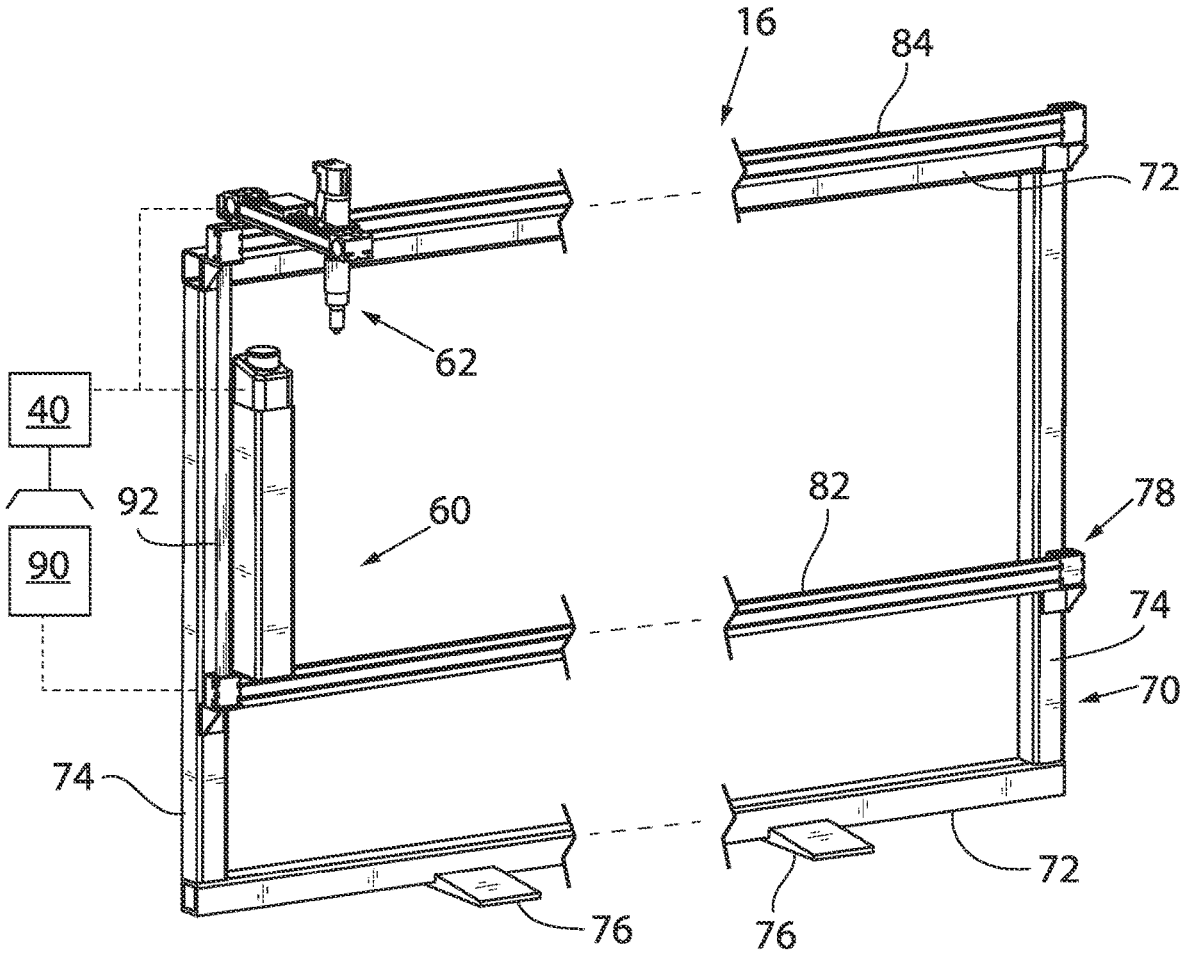
FIG. 2 is a pictorial view of a portion of a registration transfer system of the cutting system of FIG. 1.

Referring now to FIG. 2, detector and marker assemblies 60, 62 are supported by support frame 70 that is arranged at least partially in gap 50 (FIG. 1) between cutting station 12 (FIG. 1) and feed station 14 (FIG. 1). Support frame 70 includes interconnected tubes shown as horizontal tubes 72 and vertical tubes 74 that together provide an upright rectangular configuration. Feet 76 are connected to a bottom wall of the lower horizontal tube 72 to provide a stand that supports the frame 70. Carriage assembly 78 is connected to frame 70 and supports detector assembly or camera 60 and marker assembly 62, guiding their horizontal movement along the gap 50 (FIG. 1).

Still referring to FIG. 2, carriage assembly 78 is shown here with a pair of rails, with lower rail 82 supporting detector assembly 60 and upper rail 84 supporting marker assembly 62. Rails 82, 84 provide tracks (linear horizontal motion) for the detector and marker assemblies 60, 62 to move along with width of gap 50 (FIG. 1). Rails 82, 84 may internally house drive components used to move the detector and marker assemblies 60, 62, such as ball-and-screw or belt driven type actuators. As shown here, a single prime mover such as a servo motor 90 may provide motive force for moving both the detector and marker assemblies 60, 62 in unison with each other along the width of gap 50 (FIG. 1). This may be done by mechanically connecting internal drive mechanism in rails 82, 84 to each other. This is shown here a shaft 92 that rotates as driven by the drive mechanism of one of rails 82, 84 to correspondingly drive the drive mechanism of the other one of rails 82, 84.

Figure 3:
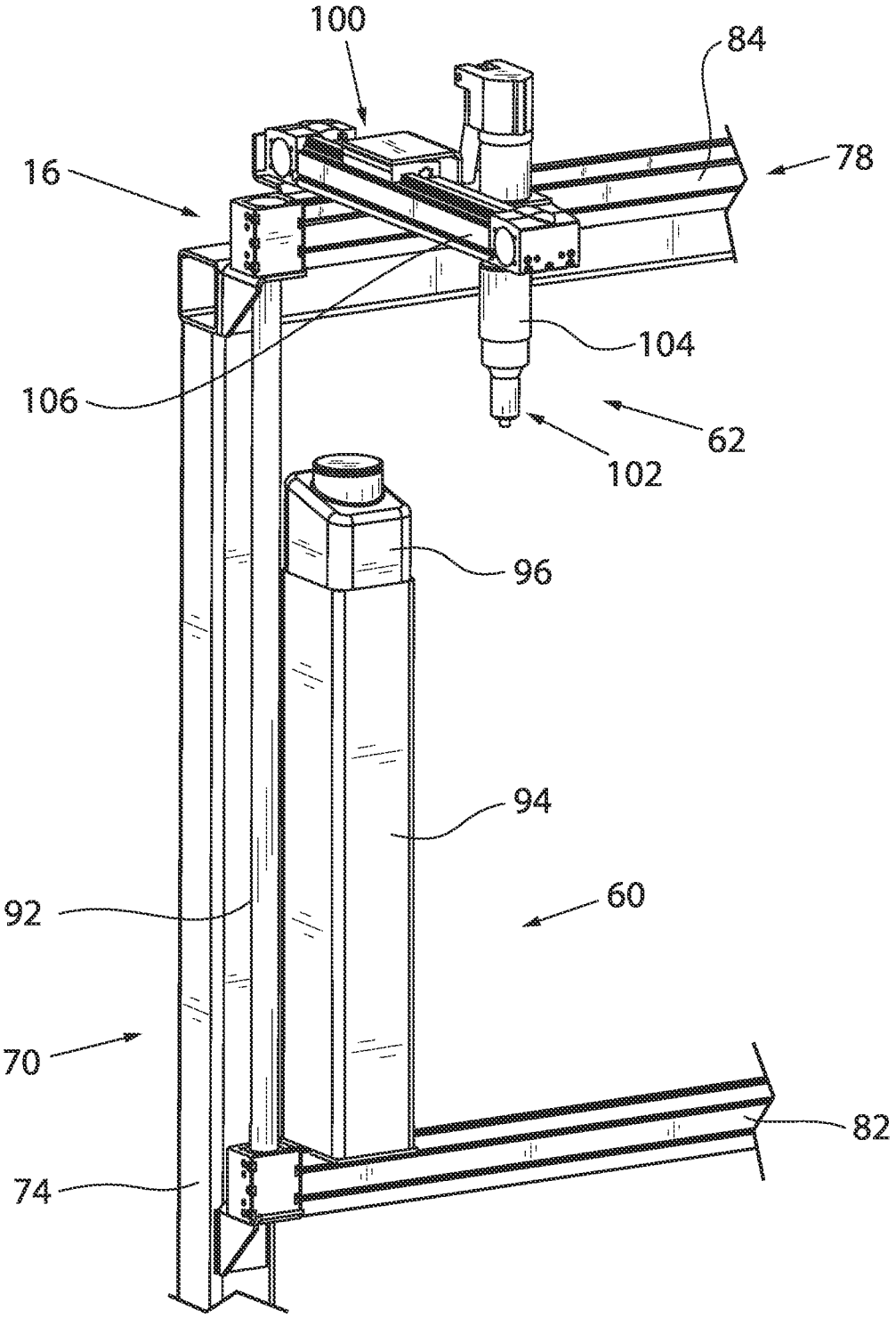
FIG. 3 is a pictorial view of various components of the registration transfer system of FIG. 2.

Referring now to FIG. 3, detector assembly 60 includes riser tube 94 that supports a detector, shown here as camera 96. A bottom end of riser tube 94 is movably connected to rail 82 for moving camera 96, with the actuation mechanism(s) mounted and spaced below camera 96. Marker assembly 62 includes marker carrier 100 that movably supports a marking device, shown here as pen 102 that is supported by pen holder 104. Pen holder 104 is supported on a marker rail 106 of marker carrier 100. Pen holder 104 is movable along marker rail 106 by a drive mechanism for moving pen 102 along the length of gap 50 (FIG. 1), between the cutting and feed stations 12, 14 (FIG. 1) or in the feed direction of boards 18 (FIG. 1). Pen holder 104 is configured to move pen 102 vertically, so the pen is three axes corresponding to the movement along the gap length, movement along the gap width, and vertical movement toward and away from the board 18 by movement(s) provided along upper rail 84, marker rail 106, and pen holder 104.

Figure 4:
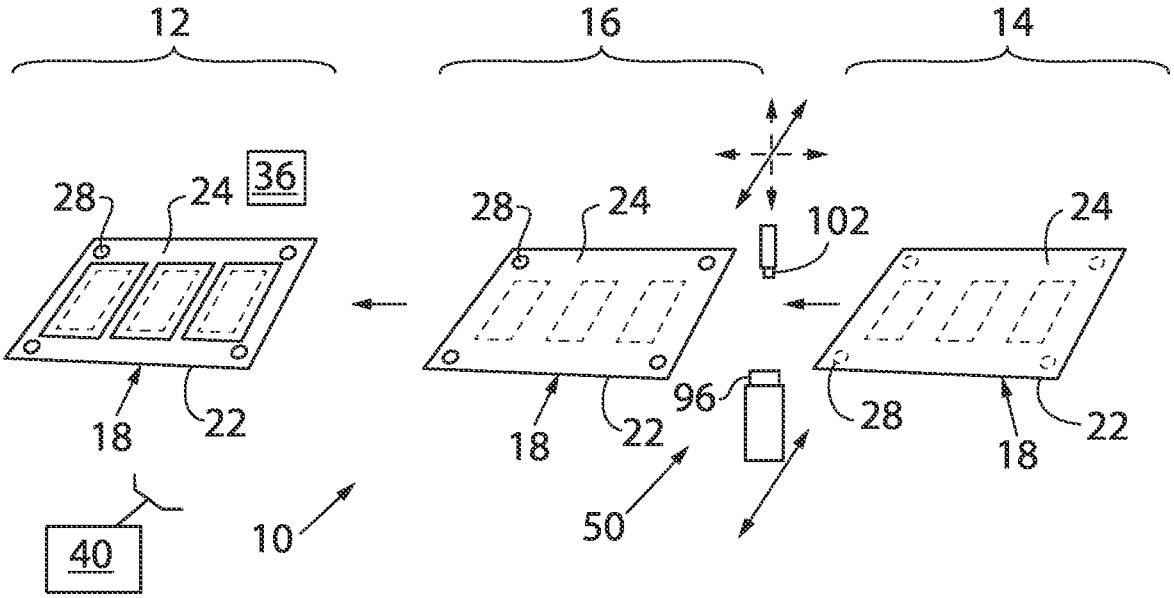
FIG. 4 is a simplified schematic representation of the cutting system of FIG. 1.

Referring now to FIG. 4, this simplified schematic representation of cutting system 10 shows the process of automatically transferring registration marks 28 from the board's 18 bottom side 22 to its top side 24. At feed station 14, board 18, with its bottom side 22 registration marks 28, is advanced toward the cutting station 12. Before getting to cutting station 12, board 18 is stopped at or slowly advanced at gap 50. Camera 96 inspects bottom side 22 by passing along the width of gap 50. Pen 102 is moved in unison with camera 96 with respect to movement along the gap's 50 width while camera 96 inspects bottom side 22 for registration marks 28. When camera 96 identifies a registration mark 28, control system 40 commands pen 102 to reproduce the registration mark 28 on the top side 24 of board 18. Pen 102 is already substantially transversely aligned with the original bottom-side registration mark 28 because of its movement in unison with camera 96 that is also substantially transversely aligned with the original bottom-side registration mark 28. Pen 102 is driven by control system 40 to reproduce the registration mark through control of actuators of marker carrier 100 and 84/82 (FIG. 3) to provide longitudinal and vertical movement of pen 102. This procedure is repeated while the uncut board 18 advances through the registration transfer system 16 until all the registration marks 28 have been transferred from the bottom side 22 of board 18 to its top side 24, such as when the entire board 18 has advanced onto cutting station 12. Change of the depiction of registration marks 28 from dashed at feed station 14 to solid at registration transfer system 16 represents transfer of the original bottom-side registration marks to transferred top-side registration marks. The uncut board 18 advances from registration transfer system 16 to cutting station 12 with transferred top side registration marks 28 that can be detected by cutter/camera head 36 even though none of the other images or other downwardly-facing indicia at the bottom side 22 of board 18 can be detected by cutter/camera head 36. Cutter/camera head 36 uses the transferred top side registration marks 28 to determine location and orientation of the downwardly-facing images or other indicia and the cutting station 12 adjusts its previously loaded cut file to accommodate the specific determined location and orientation of board 18. Cutting station 12 cuts board 18 according to the adjusted cut file as represented by the solid line rectangles outside of the dashed line rectangles of board 18. The cut board 18 is then removed from cutting station 12 and the process continues or repeats until all of the boards 18 have been processed.

Still referring to FIG. 4, some of the indicia 26 (FIG. 1) or registration marks 28 may include a bar code or QR (quick response) code that provides code data is read by camera 96 and used by control system 40 for changing to a different cut file. This allows for automatic changeover to accommodate boards 18 with different images or other indicia to be loaded in the same stack 20 yet cut according to different respective cut paths.

Many changes and modifications could be made to the invention without departing from the spirit thereof. The scope of these changes will become apparent from the appended claims. Although the best mode contemplated by the inventor of carrying out the present invention is disclosed above, practice of the above invention is not limited thereto. It will be manifest that various additions, modifications, and rearrangements of the features of the present invention may be made without deviating from the spirit and the scope of the underlying inventive concept.

What is claimed is:

1. A cutting system for cutting sheets of material, the cutting system comprising:

a cutting station, including:

a cutting table;

a cutting station inlet end at an upstream end of the cutting table that receives an uncut sheet of material into the cutting station for support on the cutting table during a cutting procedure, the uncut sheet of material having a first side with indicia and a second, opposite side;

a cutter for cutting the uncut sheet of material on the cutting table during the cutting process to provide a cut sheet of material;

a cutting station outlet end at a downstream end of the cutting table that delivers the cut sheet of material cut out of the cutting station; and a feed station, including:

a feed station inlet end that receives a stack of uncut sheets of material from which the uncut sheet of material is removed for delivery to the cutting station;

a feed station outlet end that delivers the uncut sheet of material to the cutting station in a feed direction;

a registration transfer system, including:

a detector assembly that moves with respect to the uncut sheet of material and detects indicia on the first side of the uncut sheet of material;

a marker assembly that moves in coordination with the detector assembly and is arranged to apply a mark to the second side of the uncut sheet of material at a location that corresponds to the indicia on the first side of the uncut sheet of material, wherein the uncut sheet of material defines a board and the first side of the board defines a bottom side of the board and the second side of the board defines a top side of the board.

2. The cutting system of claim 1, wherein the registration transfer system is arranged between the cutting station and the feed station.

3. The cutting system of claim 2, wherein a gap is defined between the cutting station inlet end and the feed station outlet end and the registration transfer system further comprises:

a carriage assembly that supports both the detector assembly and the marker assembly and guides movement of detector assembly along the gap between the cutting station inlet end and the feed station outlet end.

4. The cutting system of claim 3, wherein:

the board is for use as a packaging material to make boxes and packaging materials;

the indicia on the bottom side of the board includes multiple registration marks;

the detector assembly includes a camera communicating with a control system to detect the registration marks on the bottom side of the board;

the marker assembly includes a pen or other marking device that applies the detected registration marks on the bottom side of the board onto the topside of the board, directly above each of the registration marks on the bottom of the board.

5. The cutting system of claim 4, wherein the carriage assembly comprises:

a first rail that supports the camera and guides movement of the camera along the gap between the cutting station inlet end and the feed station outlet end from below; and a second rail arranged parallel to the first rail, the second rail supporting the pen and guiding movement of the pen along the gap between the cutting station inlet end and the feed station outlet end from above.

6. The cutting system of claim 5, wherein:

the gap between the cutting station inlet end and the feed station outlet end defines:

a gap length defined in the feed direction and corresponding to a distance between the cutting station inlet end and the feed station outlet end;

a gap width defined orthogonally with respect to the gap length and course corresponding to widths of the cutting station and the feed station; and wherein the carriage assembly supports the camera and pen into movement in unison with each other along a movement direction that corresponds to the gap width.

7. The cutting system of claim 6, the carriage assembly further comprising:

a pen or marking device carrier arranged at the marker assembly and configured to move the pen along three axes corresponding to the movement along the gap length, movement along the gap width, and vertical movement toward and away from the board.

8. The cutting system of claim 1, wherein the indicia includes a bar code or QR (quick response) code that provides code data usable by a control system for selecting a cutting file usable by the control system to command a cutting path for the cutter.

* * * * *